United States Patent [19]

Siegel et al.

[11] Patent Number: 4,834,264

[45] Date of Patent: May 30, 1989

[54] DEDICATED MULTI-CAVITY DISPENSER FOR SOLIDS

[75] Inventors: Harold B. Siegel; Gunter Zimmerman, both of Clearwater, Fla.

[73] Assignee: Siegel Family Revocable Trust, Clearwater, Fla.

[21] Appl. No.: 144,653

[22] Filed: Jan. 11, 1988

Related U.S. Application Data

[63] Continuation of Ser. No. 36,171, Apr. 7, 1987, abandoned, which is a continuation of Ser. No. 740,433, Jun. 3, 1985, abandoned.

[51] Int. Cl.[4] ..... B65H 3/60

[52] U.S. Cl. ..... 221/200; 221/264; 221/252; 222/228; 222/305; 222/288; 222/352

[58] Field of Search ..... 221/264

[56] References Cited

U.S. PATENT DOCUMENTS

| | | | |
|---|---|---|---|
| Re. 21,537 | 8/1940 | Schmidt | 221/201 X |
| 964,782 | 7/1910 | Hull | 221/224 X |
| 1,597,246 | 8/1926 | Query | 221/252 X |
| 1,803,656 | 5/1931 | Schuler | 221/200 |
| 2,801,025 | 7/1957 | Cookson et al. | 221/203 |
| 3,086,639 | 4/1963 | Donofrio | 221/201 X |
| 3,181,739 | 5/1965 | Dye | 222/288 |
| 3,281,012 | 10/1966 | Martell | 221/172 |
| 3,545,164 | 12/1970 | Middleton | 221/156 X |
| 3,628,694 | 12/1971 | Nichols | 221/265 |
| 3,702,103 | 11/1972 | Price et al. | 221/268 X |
| 4,065,000 | 12/1977 | Murton | 414/675 |
| 4,101,284 | 7/1978 | Difigilo et al. | 422/100 |
| 4,289,258 | 9/1981 | Ransom | 222/305 X |
| 4,295,409 | 10/1981 | Simpson | 222/305 X |
| 4,411,205 | 10/1983 | Rogers | 111/1 |
| 4,460,106 | 7/1984 | Moulding et al. | 221/265 X |

*Primary Examiner*—Joseph J. Rolla
*Assistant Examiner*—Gregory L. Huson
*Attorney, Agent, or Firm*—Pettis & McDonald

[57] ABSTRACT

An apparatus for dispensing solid objects such as, for example, pills or tablets, from a bulk supply into a receptacle containing individual doses of such medication. More particularly, the apparatus includes a series of plates, one of which is movable with respect to the other two, causing solid objects of predetermined shape and configuration to be efficiently and automatically transferred from a bulk supply source to individually accessible unit dose packages.

12 Claims, 3 Drawing Sheets

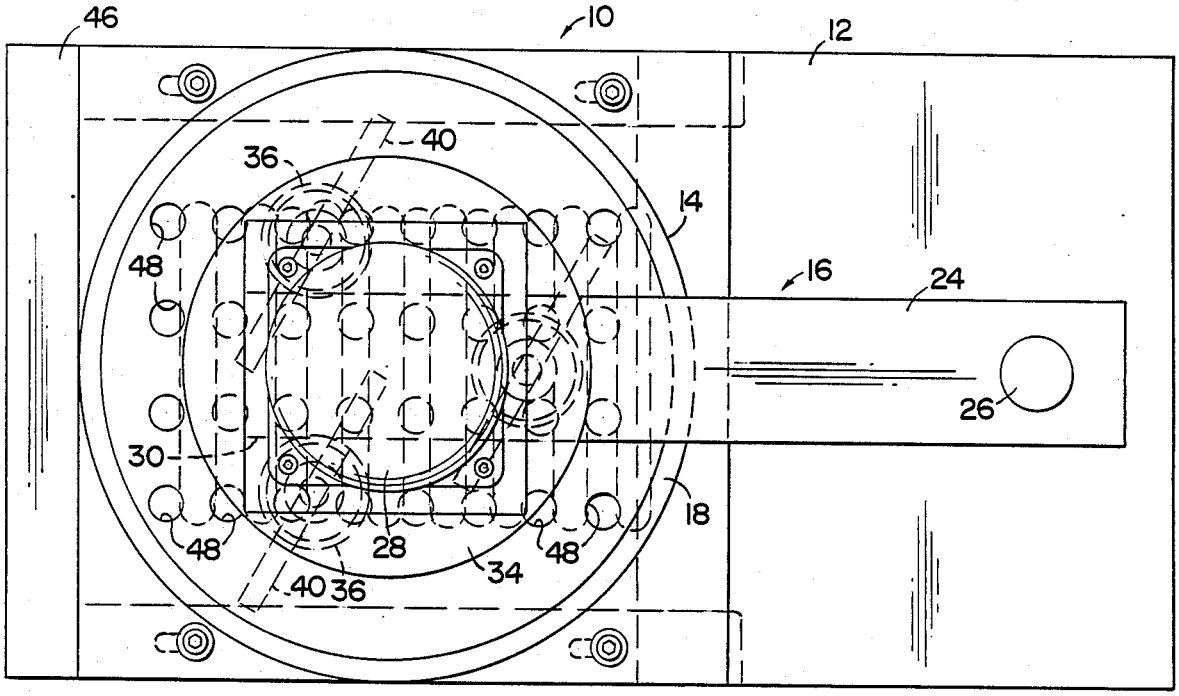
FIG.1
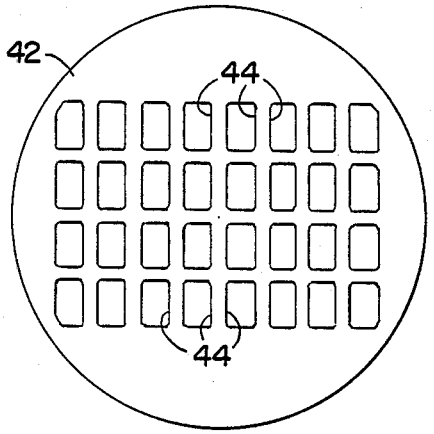
FIG. 3
FIG. 4
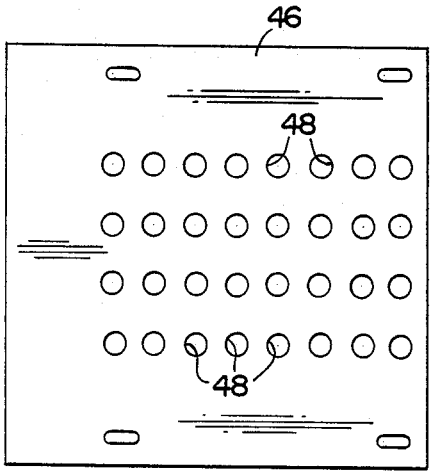
FIG. 5
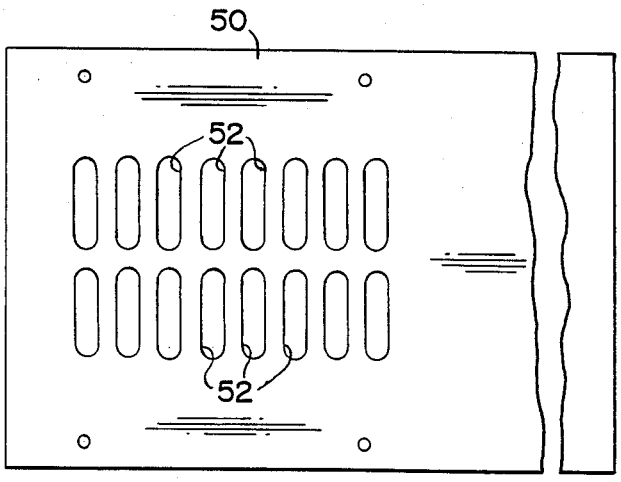

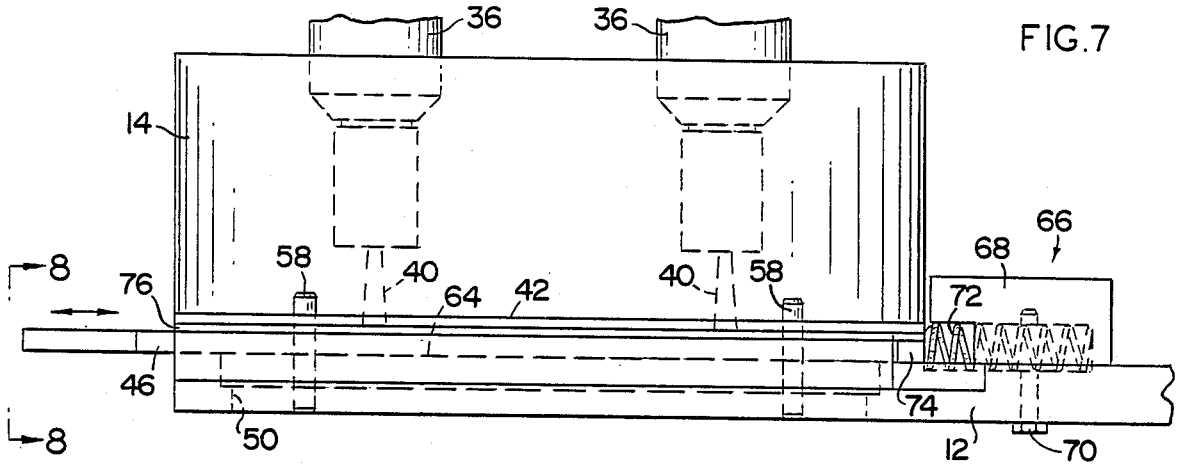
FIG.7
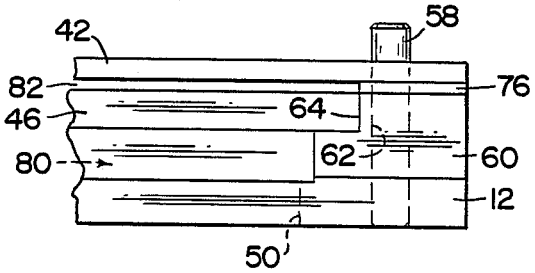
FIG.8
FIG.9
FIG.10
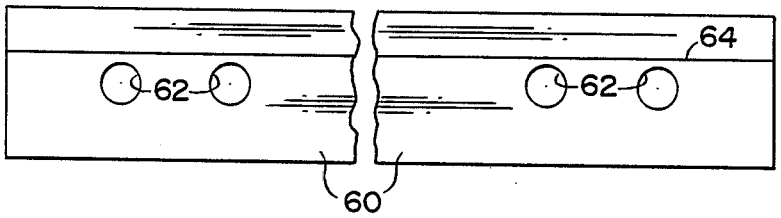
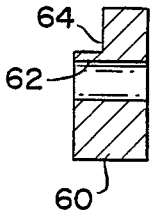
FIG.11
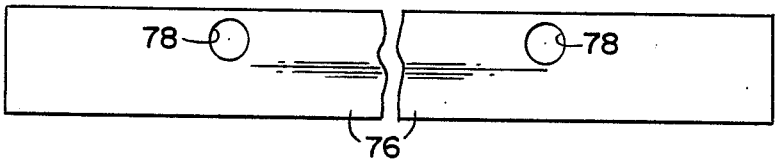
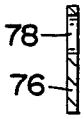
FIG.12
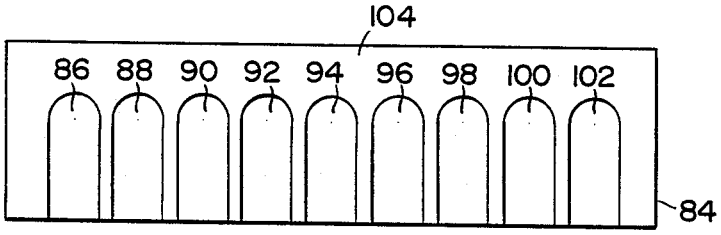
FIG.13
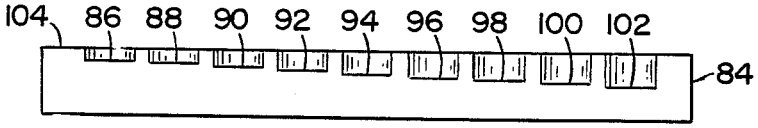
FIG.14

DEDICATED MULTI-CAVITY DISPENSER FOR SOLIDS

This application is a continuation of prior application Ser. No. 07/036,171, filed Apr. 7, 1987, now abandoned, which was in turn a continuation of prior application Ser. No. 06/740,433, filed June 3, 1985, now abandoned.

BACKGROUND OF THE INVENTION

1. Field of the Invention

The present invention relates to an automatic apparatus for transferring bulk quantities of solid objects such as, for example, medication in the form of pills, tablets, capsules, etc., into individual unit dose packages for subsequent sealing and end use. The apparatus of this invention is characterized by its construction including a series of three plates, the middle one of which is movable and specifically designed and configured to receive individual ones of the solid objects therein for transferring those objects from the bulk supply to the unit dose packages. Thus, depending upon size and shape characteristics chosen for the middle plate, or shuttle means, of the apparatus and the shuttle apertures formed therethrough, the apparatus of this invention is dedicated to automatic delivery of a particular size and shape object. Simple mechanical replacement of the shuttle means will dedicate the apparatus for use in automatically packaging other objects. The apparatus is further characterized by its inclusion of a mechanical stirring means, the action of which virtually guarantees that each unit dose receptacle will be properly filled. A second embodiment is disclosed and comprises the use of spacer means and riser means whereby different sized objects may be delivered without changing the shuttle means.

2. Description of the Prior Art

Within the medical service profession, it often occurs that a particular patient is to receive a unit dose of medication at regularly occurring intervals such as, for example, once a day. Both for purposes of insuring that medication is properly administered and taken, as well as for maintaining effective cost control, it is quite common to administer such regularly repeating doses of medication by packaging the medication in blister cards containing individually sealed doses for a week, a month, or longer. Such cards are commonly referred to within the profession as "bingo cards."

Just as the use of bingo cards for packaging unit doses of solid medication is quite common, so is an inherent difficulty associated with the preparation of such cards. Basically, two means are available today for filling the open card blisters with medication. According to one method that is available, very sophisticated and expensive machinery is utilized for the purpose of filling and sealing cards in rapid succession. Such machines are well known in the prior art and are commonly used by pharmaceutical manufacturers. A second means of preparing the cards for end use is often employed by individual health care facilities.

This second means is extremely labor-intensive, for it involves hand-filling each blister of a bingo card and then sealing the card with a rupturable material. Not surprisingly, a search of prior art patent literature reveals numerous examples of automatic dispensing and filling devices useful for depositing solid objects such as pills into multi cavity cards and strips. However, as can be seen upon reviewing the devices of such patents, the machines are relatively complex and are generally suitable for use in dispensing one particular sized and shaped object into one particular receptacle.

For example, U.S. Pat. No. 3,545,164 to Middleton teaches an apparatus for segregating, orienting and packaging capsules into an open bingo card. According to the disclosure of Middleton, the device was specifically designed and constructed to overcome orientation problems associated with packaging elongated items. No means are disclosed or suggested whereby the Middleton device could be modified for packaging items other than capsules. U.S. Pat. No. 3,628,694 to Nichols discloses a device useful for packaging medicaments in the form of tablets. The device of Nichols is disclosed as being useful for packaging continuous strips of tablets in spaced blisters formed in a thermoplastic material, and delivery of the tablets to the strips is controlled by the rotation of a plate through which the tablets fall. Yet another pertinent prior art disclosure is found in U.S. Pat. No. 4,101,284 to Difiglio. While the Difiglio dispenser is disclosed as being useful for dispensing beads used in conducting immunologic assays, it does disclose the use of an apertured, sliding plate to regulate delivery of beads in a predetermined fashion. The seed plater disclosed in U.S. Pat. No. 4,411,205 to Rogers is also deemed pertinent in that the planter of that invention also utilizes a sliding plate to control and deliver seeds from a seed hopper into planting flats. The following U.S. Patents are illustrative of other assemblies used for counting or segregating individual items by the use of either a sliding or rotating plate mechanism:

Hull, U.S. Pat. No. 964,782
Query, U.S. Pat. No. 1,597,246
Cookson, U.S. Pat. No. 2,801,025
Martell, U.S. Pat. No. 3,281,012

While it can thus be seen from the prior art cited and discussed above that various and sundry mechanisms are known for delivering and/or packaging a wide variety of solid objects, none specifically disclose means whereby the apparatus may be easily and efficiently modified to accommodate objects of various sizes and configurations. Furthermore, while some of the prior art patents do disclose means for stirring or agitating the primary source of material being dispensed, such means are quite item specific. Finally, and perhaps most significantly, in those prior art devices utilizing a three plate mechanism to control the dispensing operation, all three plates are designed and constructed to accommodate a single predetermined size and shape configuration for the article being dispensed. If it were desirable to modify the prior art devices so that they could be utilized for dispensing a different sized and/or shaped product, replacement of all three plates would be required.

It is therefore clear that there is a great need in the art for a simple, yet efficient and economical, means for dispensing solid objects into a receptacle placed downstream of the dispensing apparatus. Such a device should be capable, with only minor modification, of dispensing objects of widely differing size and shape. Furthermore, such an apparatus should also be capable of dispensing a plurality of like objects in a variety of predetermined, spaced arrays so as to permit filling of a like variety of receptacles, or cards.

SUMMARY OF THE INVENTION

The present invention relates to an apparatus dispensing, in a single operation, a plurality of solid objects from a bulk supply to a receptacle for the solid objects. More specifically, without unnecessarily limiting the scope of this invention, the dispensing apparatus finds particular utility in automatically dispensing medications such as, for example, tablets, pills, capsules, etc., from a bulk supply into individual pockets or bubbles formed on a bingo card. Once each pocket of the card has been filled, the card is removed and sealed according to standard procedures and technology.

The dispensing apparatus of this invention basically comprises a hopper means including a support frame, a collar mounted on the frame in receiving and retaining relation to the bulk supply of solid objects, and a stirring mechanism also mounted on the frame whereby the bulk supply may be agitated within the collar.

A separator means comprising an apertured plate is mounted on the support frame and substantially closes the bottom of the collar to define the bottom of the hopper means. A bulk supply of materials such as, for example, tablets, may then be placed within the collar and agitated so that at least one of the tablets will pass through each one of the separator apertures.

Also mounted on the support frame immediately below the separator means is a shuttle means comprising a second apertured plate. The shuttle means is moveably mounted for reciprocating movement between a first shuttle plate position and a second shuttle plate position. In the normal, first plate position, each of the shuttle apertures is in registry with a separator aperture so that tablets will pass from the hopper, through the separator means and into a shuttle aperture formed in the shuttle means. At this point it should be noted that both the thickness of the shuttle plate and the configuration of the shuttle apertures are predetermined with regard to corresponding characteristics of the tablet, or other material, being dispensed.

The shuttle means is then moved to its second shuttle plate position by any convenient mechanism. For example, the shuttle means could be moved from its first plate position to its second plate position manually or automatically. In either event, it is preferred, though not required, that the shuttle means be normally biased into its first shuttle plate position. While the shuttle apertures are in registry with the separator apertures in the first shuttle plate position, the shuttle apertures are no longer so registered when the second shuttle plate position is obtained.

The next primary element of the dispensing apparatus of this invention is the delivery means, also defined by a plate-type construction and including delivery apertures formed therethrough, which is fixedly mounted to the support immediately below the shuttle means in substantially parallel, abutting relation thereto. When the shuttle means is moved to its second plate position, each one of the shuttle apertures is aligned with a delivery aperture so that each one of the tablets may exit the apparatus by passing through one of the delivery apertures. An empty bingo card is disposed below (downstream) of the delivery means such that one of the tablets will be deposited into each of the receptacles formed on the bingo card. Once filled, the bingo card is removed and sealed, and an empty card is then placed below the dispensing apparatus for filling as described above.

As will be discussed in greater detail below, because only the shuttle means is specifically designed and configured with regard to the material being dispensed, the dispensing apparatus of this invention may easily be adapted to dispense a wide variety of objects simply by changing the shuttle means.

According to a second embodiment of the dispensing apparatus, the invention further comprises spacer means defined by a pair of spacer strips with one of the spacer strips being attached on opposing sides of the support frame in interposed relation between the shuttle plate and the delivery plate. In cross-section, each of the spacer strips defines a substantially L-shape, and the notches of the L-shapes face each other from opposing sides of the apparatus. The shuttle plate is movably disposed across the two spacer strips within the notches for movement therealong between the first shuttle plate position and the second shuttle plate position as described above. As will be set forth in greater detail below, the spacer strips are provided in a variety of sizes such that selection of a particular sized strip will reposition the shuttle plate, vertically, with respect to the delivery plate so that objects of different thickness may be dispensed without the necessity of changing the shuttle plate itself.

This second embodiment may further comprise riser means defined by a pair of riser strips. As with the spacer strips, one of the riser strips is attached on opposing sides of the support frame, and each riser strip is in interposed relation between the separator plate and the shuttle plate. The function of the riser means is to alter the vertical distance between the separator means and the shuttle means in predetermined fashion according to the thickness of each of the riser strips.

Accordingly, a single shuttle plate may be used for accurately delivering objects of various thicknesses simply by selecting and installing appropriate spacer means and, if necessary, riser means. Though not claimed as part of the subject matter of this invention, a gauge is provided for use in determining the thickness of the object to be dispensed, and a corresponding chart is provided to indicate what combination of spacer means and riser means is necessary for dispensing that particular thickness Proper use of both the gauge and the chart is discussed in greater detail hereinafter.

The invention accordingly comprises the features of construction, combination of elements, and arrangement of parts will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a top plan view of the dispensing apparatus with portions of the stirring means shown in phantom, ad with the separator means removed.

FIG. 3 is a plan view of one embodiment for the separator means.

FIG. 4 is a plan view of one embodiment for the shuttle means.

FIG. 5 is a plan view of one embodiment for the delivery means.

FIG. 7 is a fragmentary side elevation of a second embodiment of the dispensing apparatus, similar to that of FIG. 2, partially in section to illustrate interior detail.

FIG. 8 is a fragmentary elevational end view taken along line 8—8 of FIG. 7.

FIG. 9 is a plan view of a spacer strip.

FIG. 10 is a sectional view of the spacer strip.

FIG. 11 is a plan view of a riser strip.

FIG. 12 is a sectional view of the riser strip.

FIG. 13 is a plan view of the gauge which may be used in combination with this second embodiment.

FIG. 14 is a front side elevation of the gauge shown in FIG. 13.

Similar reference characters refer to similar parts throughout the several views of the drawings.

DETAILED DESCRIPTION

Figure 2:
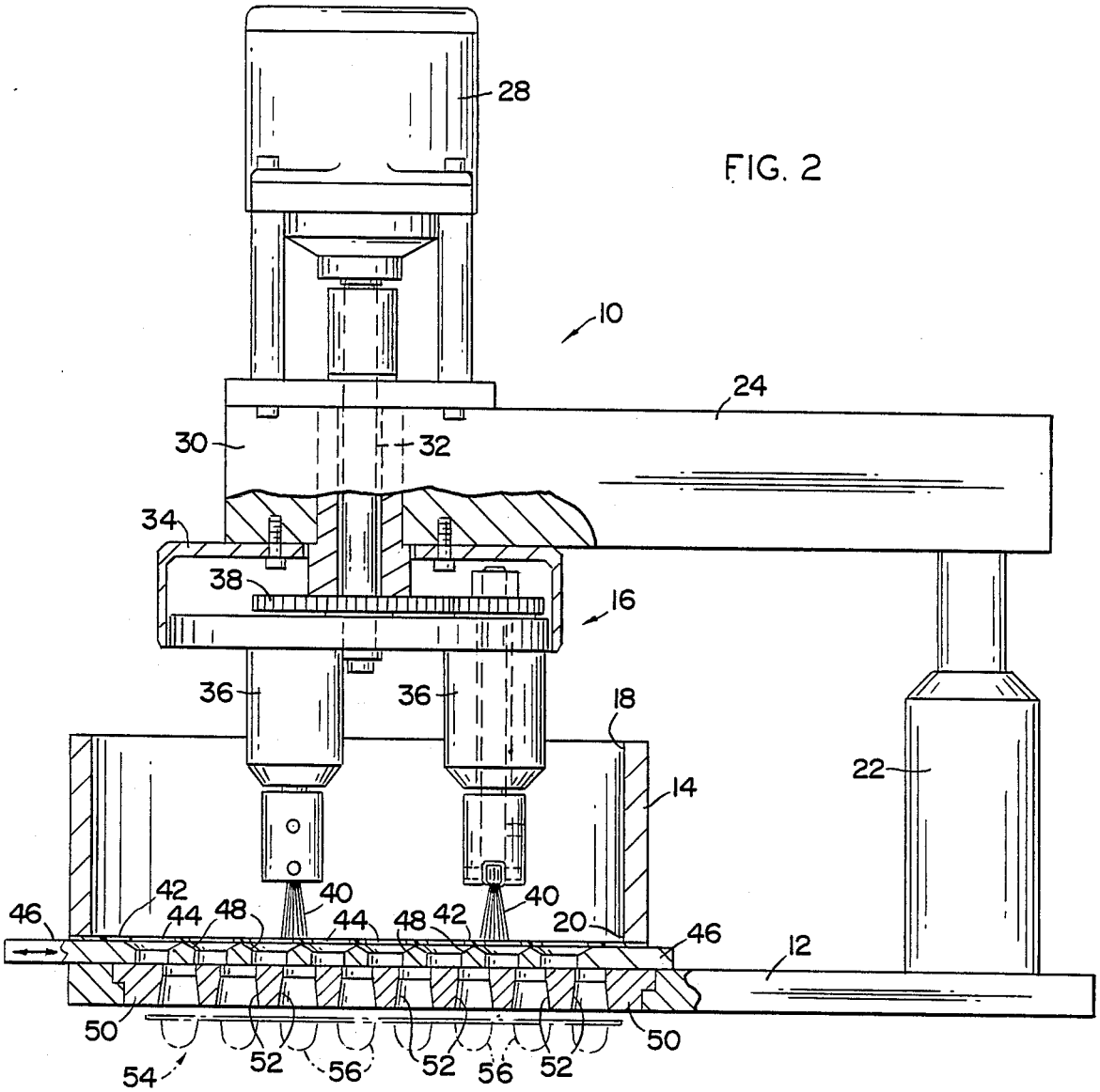
FIG. 2 is a side elevation of the dispensing apparatus, partially in section to illustrate interior detail.

The dispensing apparatus of this invention is generally indicated as 10 in the view of FIG. 2. Throughout the remainder of this detailed description, it is to be understood that while dispensing apparatus 10 will be described with particular regard to the dispensing of round tablet-type medication, the scope of this invention is not t be limited thereto. The dispensing apparatus 10 is imminently useful for dispensing a plurality of solid objects of virtually any size and/or shape from a bulk supply to a receptacle for solid objects. Furthermore, while the detailed description of this preferred embodiment for dispensing apparatus 10 will be set forth as being semi-automatic, that also is not to be interpreted as a limitation upon the scope of the invention. As will become apparent to one skilled in the art from the detailed description, apparatus 10 could be modified quite easily for fully automatic operation.

Referring to the view of FIG. 2, dispensing apparatus 10 comprises a hopper means including a support frame 12, a collar 14 mounted on frame 12, and a stirring means generally indicated as 16 also mounted on frame 12 whereby a bulk supply of tablets (not shown) may be agitated within the confines of collar 14. As clearly seen in the views of FIGS. 1 and 2, collar 14 comprises a cylinder having open first end 18 and open second end 20. Obviously, then, a bulk supply of tablets may be placed within collar 14 simply by pouring the tablets through first end 18. It should also be noted that collar 14 need not be restricted to a cylindrical configuration. However, a cylindrical configuration is preferred for the purpose of preventing the undesirable accumulation of tablets within corners, thereby permitting efficient agitation by stirring means 16.

In the preferred embodiment illustrated in FIG. 2, stirring means 16 is movably mounted on the support frame 12 by post 22 and pivoting arm 24 which extends in transverse relation to top end 26 of post 22. A motor means 28 is attached to distal end 30 of arm 24, and motor means 28 is normally electrically powered. A shaft 32 extends downwardly from motor means 28 into operative, driving relation with stirring head 34 and its stirring arms 36 through gear 38. Brushes 40 are disposed at each end of the stirring arms 36, and it is the brushes 40 which actually serve to agitate tablets placed within collar 14 of the hopper means.

In the preferred embodiment, not only do the stirring arms 36 rotate as a unit, but also each of the brushes 40 may rotate. Accordingly, the stirring motion provided by the stirring means 16 is planetary. It is to be understood, however, that stirring means 16 is not to be limited to a planetary action.

The operative bottom of the hopper means is defined by separator means 42, a plan view of which is presented of FIG. 3. As shown in the views of FIGS. 2 and 3, separator means 42 is a relatively thin plate mounted across second end 20 of collar 14 and having a plurality of separator apertures 44 formed therethrough. As stated above, it is to be remembered that separator means 42 has been omitted from the plan view of FIG. 1 for the purpose of illustrating further structural details of the apparatus 10 hereinafter. Nevertheless, as a result of the stirring action of stirring means 16 on the bulk supply of tablets placed within collar 14, at least one tablet will be deposited within each of the separator apertures 44.

Referring to the views of FIGS. 2 and 4, the dispensing apparatus 10 further comprises a shuttle means 46. Shuttle means 46 is movably mounted on frame 12 and in substantially parallel, abutting relation to separator means 42 and immediately downstream therefrom. As clearly seen in the view of FIG. 4, a plurality of shuttle apertures 48 are formed through shuttle means 46. As will be described in greater detail below, shuttle means 46 is mounted for reciprocating movement, as indicated by the arrow in the view of FIG. 2, between a first shuttle plate position and a second shuttle plate position. The view of FIG. 2 illustrates shuttle means 46 in its first shuttle plate position whereby each of the shuttle apertures 48 is in registry, and therefore tablet-receiving relation, to a separator aperture 44. The sectional view of FIG. 2 further shows that in this preferred embodiment the upper perimeter of each of the shuttle apertures 48 is chamfered. The chamfered entry into each of the shuttle apertures 48 is provided for the purpose of easing the flow of tablets from the bulk supply within collar 14, through the separator apertures 44 and into shuttle apertures 48. Inasmuch as the shuttle means 46 is normally urged into the first shuttle plate position shown in FIG. 2, tablets placed within each of the shuttle apertures 48 are held there by the blocking action of delivery means 50 as set forth hereinafter.

Again with reference to the views of FIGS. 2 and 4, and remembering that this detailed description of a preferred embodiment is being made with regard to delivering tablets, it can be seen that the configuration of each of the shuttle apertures 48 is predetermined to receive an individual tablet therein. Similarly, the relative thickness of shuttle means 46 is such that one, and only one, tablet may fit vertically within each of the shuttle apertures 48. Should it be desired to utilize apparatus 10 for dispensing objects of other than a substantially circular, tablet-shaped configuration, all that would be required would be to replace the shuttle means 46 with another embodiment having a different shape for the shuttle apertures and/or different thickness for the shuttle means itself.

The final structural element of dispensing apparatus 10 comprises the delivery means 50, one embodiment of which is shown in the plan view of FIG. 5 and in section in the view of FIG. 2. The delivery means 50 is fixedly mounted within frame 12 in substantially parallel, abutting relation to shuttle means 46 and downstream thereof. The delivery means 50 comprises a plurality of delivery apertures 52 formed therethrough whereby tablets may ultimately pass through delivery apertures 52 into a receptacle, generally indicated as 54 placed downstream of the apparatus 10. As seen in the plan view of FIG. 5, one embodiment for delivering apertures 52 may comprise elongated ovals, and it is to be understood that no limitation is intended with regard to a specific configuration for the delivery apertures 52. All that is required is that they be of sufficient size to permit passage of the tablets therethrough into receptacle 54.

Referring once again to the sectional view of FIG. 2, it can be seen that upon moving the shuttle mean 46 into its second shuttle plate position, the shuttle apertures 48 will vertically register with a corresponding one of the delivery apertures 52, permitting passage of the tablet into receptacle 54.

Figure 6:
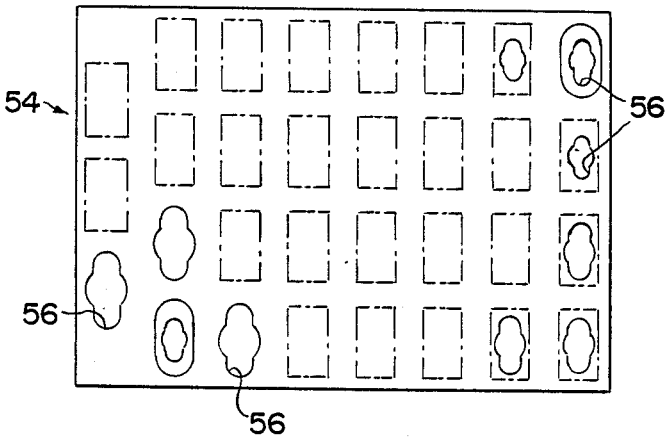
FIG. 6 is a plan view of one embodiment for a bingo card-type receptacle usable in combination with the apparatus of this invention.

In fact, other than being sufficiently sized to permit the tablet, or other object, to pass therethrough, the shape and placement of delivery apertures 52 are primarily determined with regard to the configuration of individual blisters 56 formed on the receptacle 54 which, as seen in the view of FIG. 6, is a thirty-one day bingo card. As suggested above, and though not forming part of the claimed invention, it is contemplated that automatic or semi automatic means could be provided for inserting empty receptacles 54 beneath the apparatus 10 and sequentially removing the filled card and providing another empty card in succession. For example, a form of conveyor means could be utilized, timing the movement of the conveyor means with the reciprocating action of shuttle means 46.

Having thus set forth a preferred embodiment for the dispensing apparatus 10 of this invention, one skilled in the art may fully appreciate its relative simplicity and its great utility. While the structural elements of apparatus 10 may be formed from any suitable material, inasmuch as the device will find great utility in packaging unit dose solid medications, those elements which will come into contact with the medication must be susceptible of being sterilized. Such elements may be formed from stainless steel or from plastics or other synthetic materials.

Turning now to the views of FIGS. 7–14, a second embodiment for the dispensing apparatus of this invention is illustrated. As already indicated in the summary of the invention, above, one of the unique features of the second embodiment is the inclusion of spacer means and riser means whereby a single shuttle means 46 may be used for delivering tablets of various sizes. Of course, in the views of FIGS. 7 and 8 those structural elements corresponding to ones already described are identified with similar reference numerals.

Referring to the view of FIG. 7, it can be seen that a pair of posts 58 extend upwardly from the support frame 12. Of course, in the view of FIG. 7, the two posts 58 on the other side of dispensing apparatus 10 are not visible. Posts 58 provide mounting means for attaching not only the separator means 42 to the apparatus 10, but also for the new structural elements of this second embodiment as described hereinafter. The delivery means 50 is inserted into support frame 12 as previously described and as illustrated in the view of FIG. 8.

Appropriate spacer means comprising a pair of spacer strips 60 are then attached on opposing sides of the support frame 12 by passing posts 58 through corresponding ones of the spacer apertures 62. A plurality of apertures 62 are provided through each of the spacer strips 60 so that either of the strips 60 may be installed on either side of apparatus 10, but the spacer apertures 62 are arranged so that the spacer strips 60 will only fit properly when space notch 64 of each strip 60 faces the corresponding notch 64 on the opposing strip 60. The shuttle means 46 is then movably disposed within the dispensing apparatus 10 and is supported along its sides by opposing notches 64 of the two spacer strips 60. As indicated by the double headed arrow in the view of FIG. 7, and as previously described above, shuttle means 46 may be moved back and forth between a first shuttle plate position and a second shuttle plate position to accomplish delivery of the tablets or other solid material.

The shuttle means 46 is normally urged into its first shuttle plate position as shown in the view of FIG. 7 by the action of shuttle biasing means generally indicated as 66 in the view of FIG. 7. Shuttle biasing means 66 comprises a housing 68 attached to support frame 12 by any suitable fastening means 70. A spring 72 is mounted within housing 68 and includes a tip 74 attached at one end thereof in abutting relation to the back edge of the shuttle means 46. Spring 72 and its tip 74 normally urge shuttle means 46 into the first shuttle plate position illustrated in FIG. 7. Upon pushing the shuttle means 46 rearwardly, its shuttle apertures (not shown) will register with the corresponding delivery apertures (not shown) formed through delivery means 50 to permit dispensing of tablets. Then upon releasing shuttle means 46, shuttle biasing means 66 will return the shuttle means 46 from its second shuttle plate position to the illustrated first shuttle plate position.

The second embodiment for the dispensing apparatus 10 may further comprise riser means defined by a pair of riser strips 76, with one of each of the riser strips 76 being mounted in opposing relation to the other along each side of dispensing apparatus 10. As perhaps best seen in the view of FIG. 8, attachment of each of the riser strips 76 is similar to that for the attachment of each of the spacer strips 60 in that the riser strips 76 are mounted by inserting a corresponding one of the posts 58 through corresponding ones of the riser apertures 78 formed through each of the strips 76. Finally, the separator means 42 is mounted as shown in the view of FIG. 8, and collar 14 is placed thereover.

The purpose of the spacer strips 60 and the riser strips 76 is to permit utilization of a single shuttle means 46 for dispensing objects of varying sizes. As best seen in the view of FIG. 8, utilization of spacer strips 60 will create a delivery void 80 between shuttle means 46 and delivery means 50. Should even greater depth be required for the object being delivered, utilization of riser strips 76 will create a separator void 82 between separator means 42 and shuttle means 46. By providing a plurality of spacer strips 60 and riser strips 76 of differing thicknesses, with "thickness" of these elements being measured with regard to the axial length of their corresponding apertures 62 and 78, a single shuttle means 46 may be used to deliver objects of various thicknesses.

For the purpose of determining what size and combination of spacer strips 60 and riser strips 76 are to be utilized for a particular object, a gauge 84 is provided as clearly seen in the views of FIGS. 13 and 14, gauge 84 basically comprises a block having a plurality of slots 86, 88, 90, 92, 94, 96, 98, 100 and 102 formed along top 104 of gauge 84. As seen in the side view of FIG. 14, each of the slots 86–102 is of a different depth. The object to be dispensed is placed in various ones of the slots until the appropriate size is determined. Appropriate size may be visually observed by selecting the first of the slots in which the object can be placed and yet not be visible along the line of sight taken across gauge top 104.

A gauge chart will be provided to the end use of this second embodiment for dispensing apparatus 10, and that gauge chart will instruct the user as to the proper selection of spacer strips 60 and riser strips 76, as necessary, to set up apparatus 10 for delivery of an object of the indicated size. Though not to be limited thereto, utilizing three sizes and configurations for the shuttle means 46, five sizes of spacer strips 60, and two sizes of riser strips 76, at least 30 different sizes of objects such as tablets or capsules, for example, may be efficiently and accurately dispensed.

It will thus be seen that the objects set forth above, among those made apparent from the preceding description, are efficiently attained and, since certain changes may be made in the above construction without departing from the scope of the invention, it is intended that all matter contained in the above description are shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. In an apparatus for dispensing a plurality of pills or tablets or capsules in the form of solid objects, from a bulk supply to a receptacle for the solid objects, said apparatus having hopper means including a support frame for receiving the bulk supply of solid objects; separator means defining the bottom of said hopper means, said separator means including a plurality of separator apertures formed therethrough, shuttle means movably disposed in substantially parallel, juxtaposed relation to said separator means and downstream of said separator means with respect to the flow of solid objects from said hopper means to the receptacle, said shuttle means including a plurality of shuttle apertures formed therethrough; delivery means fixedly disposed in substantially parallel, juxtaposed relation to said shuttle means and downstream of said shuttle means, said delivery means including a plurality of delivery apertures formed therein through which the solid objects ultimately pass into a receptacle placed downstream of said apparatus, the improvement comprising spacer means defined by a pair of replaceable spacer strips, each of said spacer strips being attached on opposing sides of said support frame in interposed relation between said shuttle means and said delivery means, each of said spacer strips defining a substantially L-shaped cross-section with the notch of each of said L-shapes facing the corresponding notch of the opposed spacer strip, said shuttle means being movably disposed across said spacer strips within said notches, when the spacer strips are replaced by ones having notches of different thickness the distance between said shuttle means and said delivery means is adjusted by the difference in thickness of the notch in the replaced spacer strips, and, riser means defined by a pair of riser strips, one of said riser strips being attached on opposing sides of said support frame in interposed relation between said separator means and said shuttle means, whereby the distance between said separator means and said shuttle means may be adjusted.

2. An apparatus as in claim 1 further comprising shuttle biasing means attached to said support frame in engaging relation to a portion of said shuttle means, whereby said shuttle means is normally urged to a first shuttle plate position and, upon overcoming the normal force of said shuttle biasing means, may be moved to a second shuttle plate position.

3. An apparatus as in claim 1 wherein said hopper means comprises a collar mounted on said frame in receiving and retaining relation to the bulk supply of solid objects, and a stirring means mounted on said frame whereby the bulk supply solid objects may be agitated within said collar.

4. An apparatus as in claim 3 wherein said stirring means is movably mounted on said support frame, said stirring means comprising a plurality of stirring arms and motor means operatively connected to said arms, whereby said arms may agitate the bulk supply within said collar.

5. An apparatus as in claim 3 wherein said collar comprises a cylinder having open first and second ends.

6. An apparatus as in claim 5 wherein said delivery means comprises a delivery plate attached to said support frame and wherein the central axis of each of said delivery apertures is in non-registering relation to the central axis of a corresponding one of said separator apertures.

7. An apparatus as in claim 3 wherein said separator means substantially closes said second end of said collar to define the bottom of said hopper means.

8. An apparatus as in claim 7 wherein said separator apertures are each dimensioned and configured to receive at least one of the solid objects therein.

9. An apparatus as in claim 8 wherein said shuttle means comprises a shuttle plate, said shuttle plate being movably mounted on said frame for reciprocating movement between a first shuttle plate position and a second shuttle plate position.

10. An apparatus as in claim 9 wherein said reciprocating movement is substantially transverse to the central axis of each one of said plurality of separator apertures, said shuttle apertures and said delivery apertures.

11. An apparatus as in claim 10 wherein said first shuttle plate position is defined by vertical registry of the central axis of each one of said separator apertures with the central axis of a corresponding one of said shuttle apertures.

12. An apparatus as in claim 1 wherein said second shuttle plate position is defined by vertical registry of the central axis of each one of said shuttle apertures with the central axis of a corresponding one of said delivery apertures.

* * * * *

UNITED STATES PATENT AND TRADEMARK OFFICE

CERTIFICATE OF CORRECTION

PATENT NO. : 4,834,264

DATED : MAY 30, 1989

INVENTOR(S) : HAROLD B. SIEGEL; GUNTER ZIMMERMAN

It is certified that error appears in the above-identified patent and that said Letters Patent is hereby corrected as shown below:

Column 10, line 32, the numeral "3" should be --5--.

Column 10, line 52, the numeral "1" should be --11--.

Signed and Sealed this

Twenty-seventh Day of February, 1990

*Attest:*

JEFFREY M. SAMUELS

*Attesting Officer* *Acting Commissioner of Patents and Trademarks*